US005192737A

United States Patent [19]

Kubodera et al.

[11] Patent Number: 5,192,737

[45] Date of Patent: Mar. 9, 1993

[54] HEAT TRANSFER DYE-PROVIDING MATERIAL

[75] Inventors: Seiiti Kubodera; Kozo Sato, both of Kanagawa, Japan

[73] Assignee: Fuji Photo Film Co., Ltd., Kanagawa, Japan

[21] Appl. No.: 787,611

[22] Filed: Nov. 4, 1991

[30] Foreign Application Priority Data

Nov. 6, 1990 [JP] Japan ..... 2-299007

[51] Int. Cl.[5] ..... B41M 5/035; B41M 5/26

[52] U.S. Cl. ..... 503/227; 428/195; 428/913; 428/914; 430/200; 430/201; 430/202; 430/945

[58] Field of Search ..... 8/471; 428/195, 913, 428/914; 430/200, 201, 202, 913, 914; 503/227

[56] References Cited

U.S. PATENT DOCUMENTS 5,026,679 6/1991 Evans et al. ..... 503/227

*Primary Examiner*—B. Hamilton Hess

*Attorney, Agent, or Firm*—Sughrue, Mion, Zinn, Macpeak & Seas

[57] ABSTRACT

There is disclosed a thermal transfer dye-providing material capable of providing a sharp image having a high density. The dye-providing material includes a support having provided thereon a layer containing a thermally migrating dye, wherein at least one of the dye-containing layer and a layer adjacent thereto contains an infrared-absorbing dye represented by Formula (I), (II) or (III):

Formula (I)

Formula (II)

Formula (III)

13 Claims, No Drawings

HEAT TRANSFER DYE-PROVIDING MATERIAL

FIELD OF THE INVENTION

The present invention relates to a dye-providing material used for heat transfer with an induced laser. More specifically, the present invention relates to a heat transfer dye providing material containing a specific infrared-absorbing dye.

BACKGROUND OF THE INVENTION

In recent years, a heat transfer system has been developed for preparing a print from an image which has been electronically formed in a color video camera. In one method for preparing such a print, an electronic image is first subjected to color separation with a color filter. Next, the respective color-separated images are converted to electric signals. Subsequently, these signals are modulated to generate electric signals for yellow, magenta and cyan, and then these signals are transmitted to a thermal printer. In order to obtain the print, a dye-providing material of yellow, magenta or cyan is disposed face to face on a dye image-receiving material. Then, both are interposed between a thermal head and a platen roller and are heated from the backside of the dye-providing material with a line type thermal head. The thermal head has many heating elements, which are heated one by one in response to the yellow, magenta and cyan signals. Subsequently, this procedure is repeated for the other two colors. Thus, a color hard copy corresponding to the original image seen on a display can be obtained.

In another method of thermally obtaining a print with the electrical signals mentioned above, the thermal head can be replaced with a laser. In this system, the dye-providing material contains a substance capable of intensely absorbing laser light. The laser light is irradiated on the dye-providing material, and the absorptive substance converts the light energy to thermal energy; the energy is immediately transferred to the neighboring dyes, whereby the dyes are heated to a thermally immigrating temperature in order to transfer the dyes to the image-receiving material. The absorptive substance is present under the dye in a layer and/or is mixed with the dye. A laser beam is modulated with the electric signals corresponding to the shape and color of the original image, and only the dyes in the area necessary to be thermally immigrated in order to reconstruct the colors of the original image are heated for thermal transfer. More detailed explanations of the above process can be found in British Patent 2,083,726 A, in which the absorptive substance disclosed therein for the laser system is carbon.

The problem in using carbon as the absorptive substance lies in the fact that carbon comprises fine particles and that it is liable to flocculate in coating, which deteriorates the quality of the transfer-red image. Further, carbon is transferred to the image-receiving material by adhesion or abrasion, which causes speckles and insufficient color in the color image.

SUMMARY OF THE INVENTION

An object of the present invention is to provide an absorptive substance having no such defects.

The above and other objects can be achieved by a thermal transfer dye-providing material comprising a support and provided thereon a layer containing a thermally migrating dye, wherein at least one of the dye-containing layer and a layer adjacent thereto contains an infrared-absorbing dye represented by Formula (I), (II) or (III):

Formula (I)

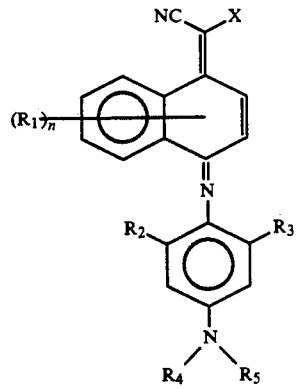

Formula (II)

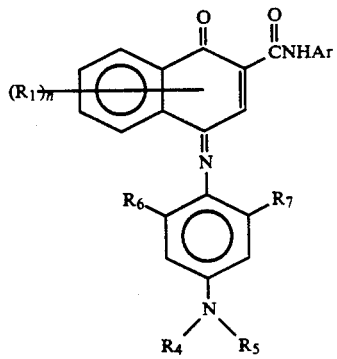

Formula (III)

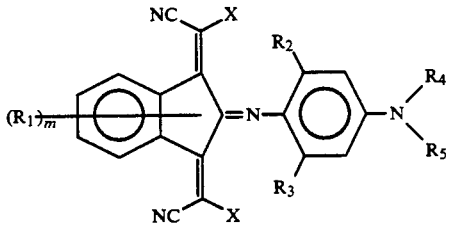

wherein $R_1$ represents a halogen atom, an alkoxy group, an aryloxy group, an acylamino group, an alkoxycarbonylamino group, a sulfonylamino group, a sulfamoyl group, a hydroxyl group, a sulfonyl group, or a ureido group; n represents an integer of from 0 to 3, provided that $R_1$'s may be the same or different when n is 2 or 3; m represents an integer of from 0 to 2, provided that $R_1$'s may be the same or different when m is 2; $R_2$ and $R_3$ can be the same or different and independently represent a hydrogen atom, an alkyl group, an alkoxy group, a halogen atom, an acylamino group, an alkoxycarbonylamino group, or a ureido group; $R_4$ and $R_5$ can be the same or different and independently represent a hydrogen atom, an alkyl group, or an aryl group, provided that $R_4$ and $R_5$ may be combined with each other to form a ring and that $R_4$ and $R_5$ may be combined with a benzene ring to form a 5- or 6-membered nitrogen-containing heterocyclic group; $R_6$ and $R_7$ can be the same or different and independently represent an alkyl group, an alkoxy group, a halogen atom, an acylamino group, an alkoxycarbonylamino group, or a ureido group; X represents a cyano group, an acyl group, an alkoxycarbonyl group, a carbamoyl group, or a sulfonyl group; Ar represents an aryl group or a heteroaryl group; provided that the above groups can be substituted with other groups and that, in Formulae (I) and (III), the CN and X groups which are bonded to the same carbon atom can change positions with each other.

DETAILED DESCRIPTION OF THE INVENTION

The compounds of Formulae (I), (II) and (II) will be explained in detail below.

In formulae (I) and (III), the cis-trans configuration of

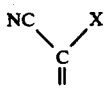

groups may be reversed to

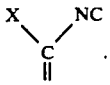

$R_1$ represents a halogen atom (e.g., fluorine, chlorine and bromine), an alkoxy group which can be substituted and can have up to 20 carbon atoms (e.g., methoxy and ethoxy), an aryloxy group which can be substituted and can have up to 20 carbon atoms (e.g., phenoxy and 2-fluorophenoxy), an acylamino group which can have up to 20 carbon atoms (e.g., acetylamino, propionylamino and trifluoroacetylamino), an alkoxycarbonylamino group which can be substituted and can have up to 20 carbon atoms (e.g., methoxycarbonylamino and ethoxycarbonylamino), a sulfonylamino group which can have up to 20 carbon atoms (e.g., methylsulfonylamino and phenylsulfonylamino), a sulfamoyl group which can have up to 20 carbon atoms (e.g., N,N-dimethylsulfamoyl and N,N-diethylsulfamoyl), a hydroxyl group, a sulfonyl group which can have up to 20 carbon atoms (e.g., methylsulfonyl and ethylsulfonyl), or a ureido group which can have up to 20 carbon atoms (e.g., 3,3-dimethylureido); n represents an integer of 0 to 3, preferably 0; and m represents an integer of 0 to 2, preferably 0.

$R_2$ and $R_3$ independently represent a hydrogen atom, an alkyl group which can be substituted and which can have up to 20 carbon atoms (e.g., methyl and ethyl), an alkoxy group which can be substituted and which can have up to 20 carbon atoms (e.g., methoxy and ethoxy), a halogen atom (e.g., fluorine, chlorine and bromine), an acylamino group which can have up to 20 carbon atoms (e.g., acetylamino, propionylamino and trifluoroacetylamino), an alkoxycarbonylamino group which can be substituted and which can have up to 20 carbon atoms (e.g., methoxycarbonylamino and ethoxycarbonylamino), or a ureido group which can have up to 20 carbon atoms (e.g., 3,3-dimethylureido and 3-methylureido). Preferred examples of the groups represented by $R_2$ and $R_3$ are a hydrogen atom, an alkyl group, an alkoxy group, an acylamino group, and an alkoxycarbonylamino group. Among these groups, a hydrogen atom, a methyl group, a methoxy group, an acetylamino group, a methoxycarbonylamino group, and an ethoxycarbonylamino group are particularly preferred.

$R_4$ and $R_5$ independently represent a hydrogen atom, an alkyl group which can be substituted and which can have up to 20 carbon atoms (e.g., ethyl, methoxyethyl, hydroxyethyl and methanesulfonylaminoethyl), or an aryl group which can be substituted and which can have up to 20 carbon atoms (e.g., phenyl, p-tolyl, p-methoxyphenyl and p-chlorophenyl). Of the above groups, the alkyl group is preferable. Preferred examples thereof are ethyl, methanesulfonylaminoethyl and cyanoethyl. Further, other preferred examples are a piperidine ring which is formed by combining $R_4$ with $R_5$ and a tetrahydroquinoline ring which is formed by combining $R_4$ with a benzene ring.

$R_6$ and $R_7$ independently represent an alkyl group which can be substituted and which can have up to 20 carbon atoms (e.g., methyl and ethyl), an alkoxy group which can be substituted and which can have up to 20 carbon atoms (e.g., methoxy and ethoxy), a halogen atom (e.g., fluorine, chlorine and bromine), an acylamino group which can have up to 20 carbon atoms (e.g., acetylamino, propionylamino and trifluoroacetylamino), an alkoxycarbonylamino group which can be substituted and which can have up to 20 carbon atoms (e.g., methoxycarbonylamino and ethoxycarbonylamino), or a ureido group which can have up to 20 carbon atoms (e.g., 3,3-dimethylureido and 3-methylureido). Preferred examples of the groups represented by $R_6$ and $R_7$ are an alkyl group, an alkoxy group, and an alkoxycarbonylamino group. Of them, a methyl group, a methoxy group, a methoxycarbonylamino group, and an ethoxycarbonylamino group are particularly preferred.

X represents a cyano group, an acyl group which can have up to 20 carbon atoms (e.g., acetyl, propionyl and benzoyl), an alkoxycarbonylamino group which can be substituted and which can have up to 20 carbon atoms (e.g., methoxycarbonylamino and ethoxycarbonylamino), a carbamoyl group which can have up to 20 carbon atoms (e.g., N-methylcarbamoyl and N-phenylcarbamoyl), or a sulfonyl group which can have up to 20 carbon atoms (e.g., methylsulfonyl and phenylsulfonyl). Among these groups, a cyano group, an alkoxycarbonyl group, and a carbamoyl group are preferred.

Ar represents an aryl group which can be substituted and which can have up to 20 carbon atoms (e.g., phenyl, p-cyanophenyl, p-chlorophenyl, p-nitrophenyl, 3,4-dichlorophenyl, and 3,5-dichlorophenyl), and a heteroaryl group (e.g., 2-thiazolyl, 2-benzothiazolyl, -pyridyl, 4-pyridyl, 5-methyl-1,3,4-thiadiazole-2-yl, and 4-methylthiazole-2-yl). The aryl group and the heteroaryl group preferably have an electron-attracting property.

The preceding infrared-absorbing dye may be used in any concentration, as long as it can provide the desired effect. In general, the dye can be used in the concentration of from about 0.04 to about 0.5 $g/m^2$ in a dye-providing layer itself or a layer adjacent thereto to obtain excellent results.

The spacer beads provided on the dye-providing layer may be used as a separating layer in order to separate satisfactorily the dye-providing material from the image-receiving material to thereby improve the uniformity of dye transferring and to increase the density of the transferred dye image.

Examples of the infrared-absorbing dye used in the present invention are shown below, although these examples should not be construed as limiting the present invention in any way:
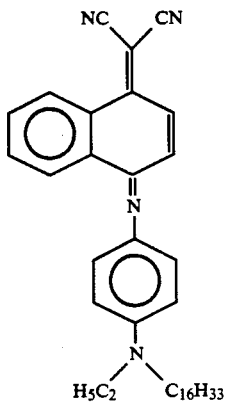
(1)
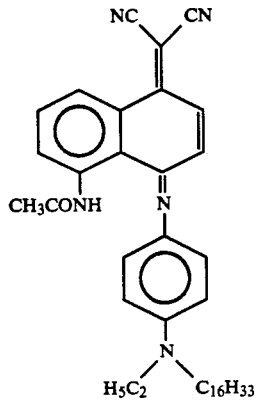
(2)
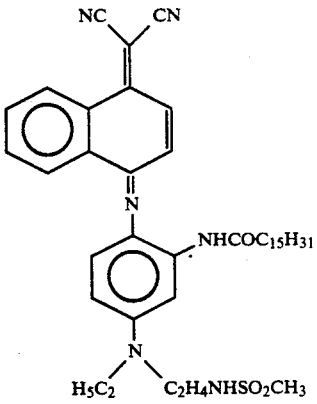
(3)
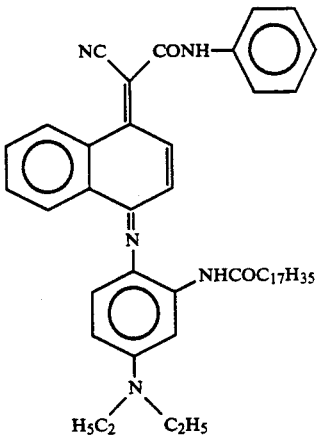
(4)
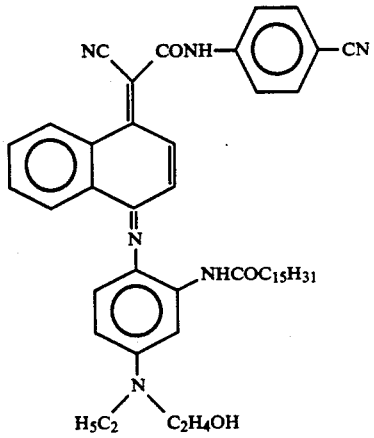
(5)
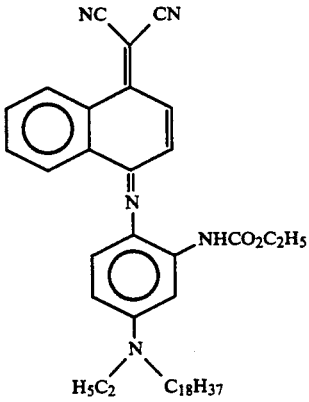
(6)

-continued
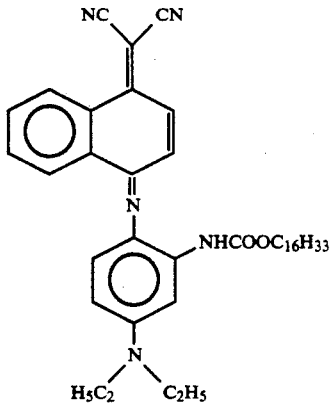
(7)
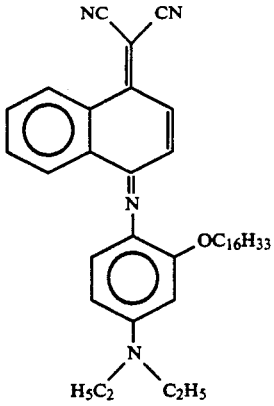
(8)
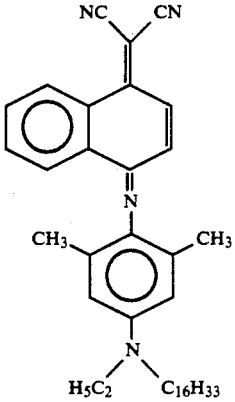
(9)
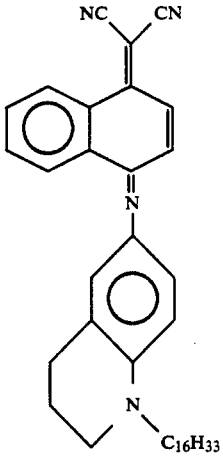
(10)
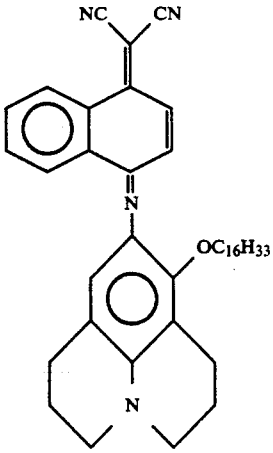
(11)
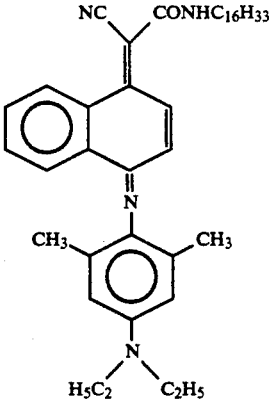
(12)

-continued
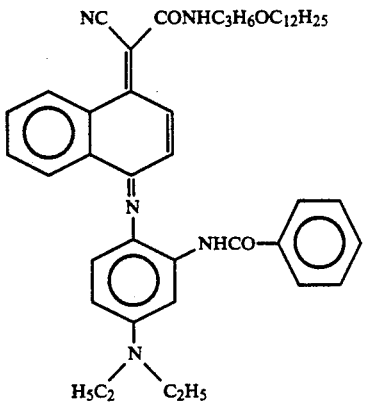
(13)
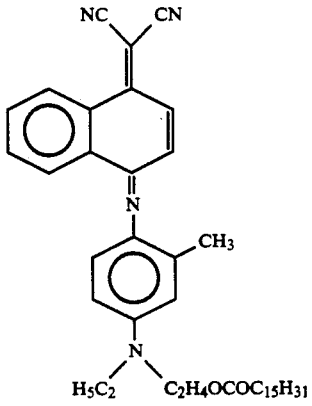
(14)
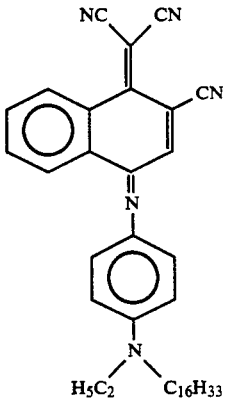
(15)
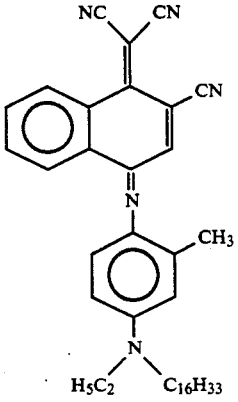
(16)
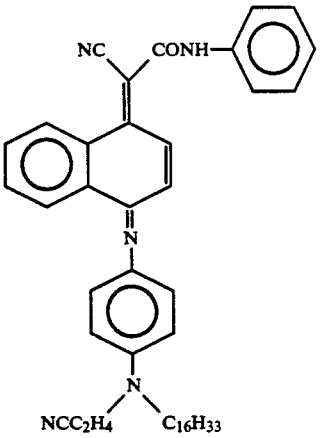
(17)
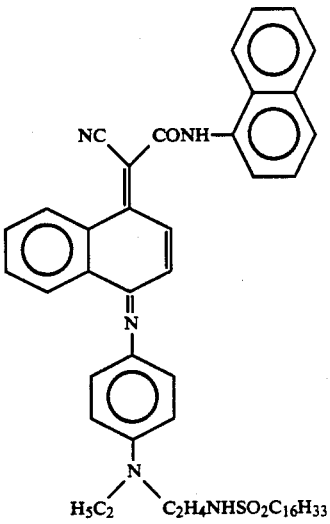
(18)

-continued
(19)
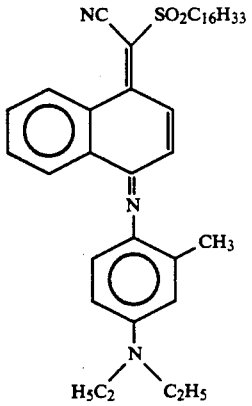
(20)
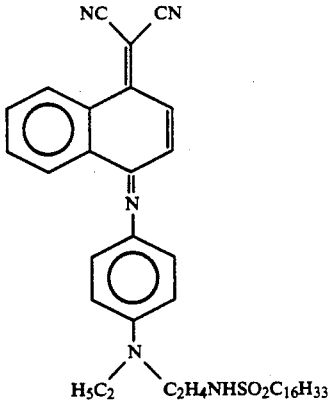
(21)
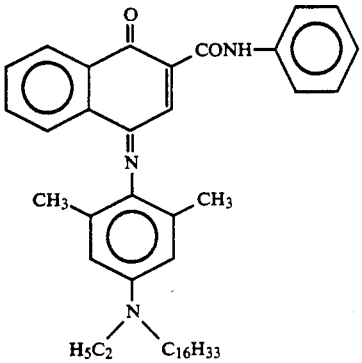
(22)
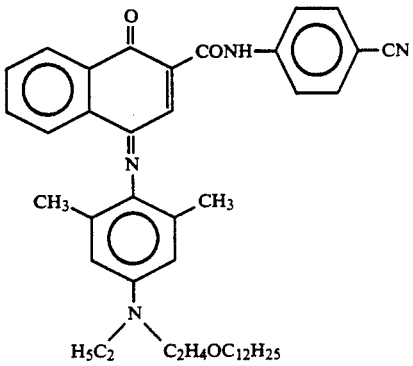
(23)
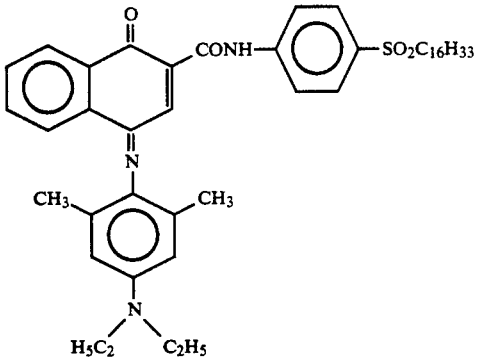
(24)
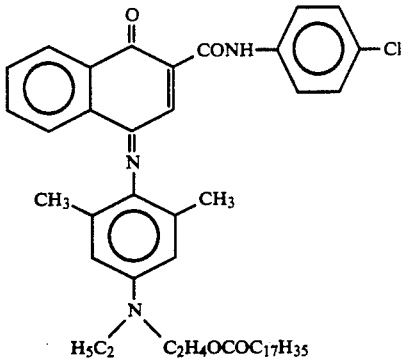
(25)
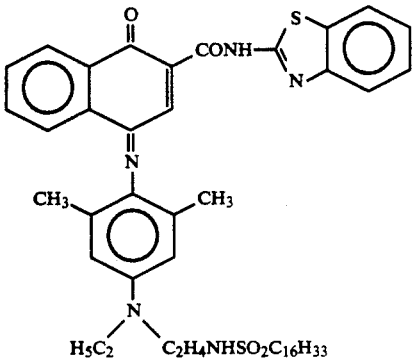
(26)
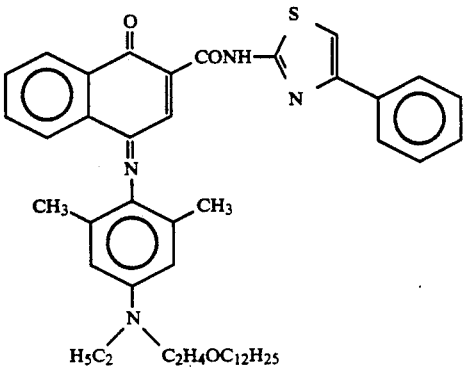

-continued
(27)
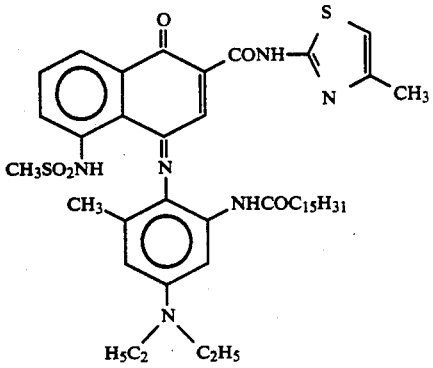
(28)
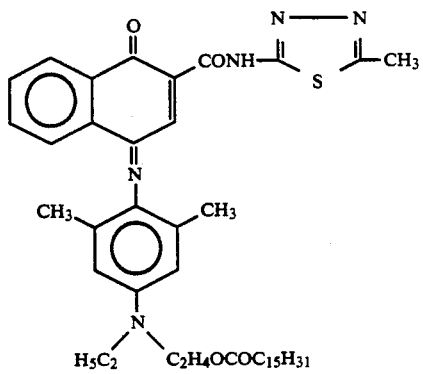
(29)
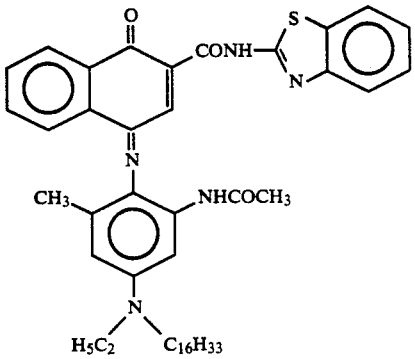
(30)
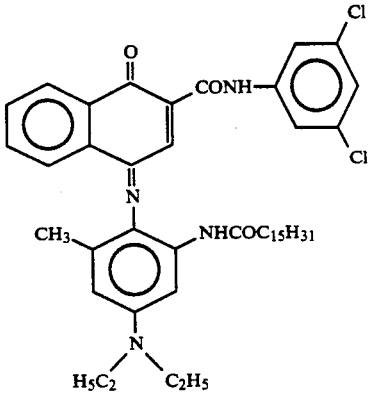
(31)
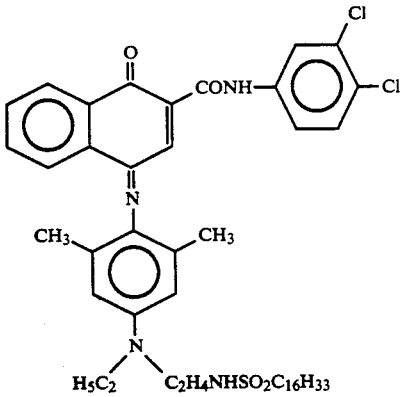
(32)
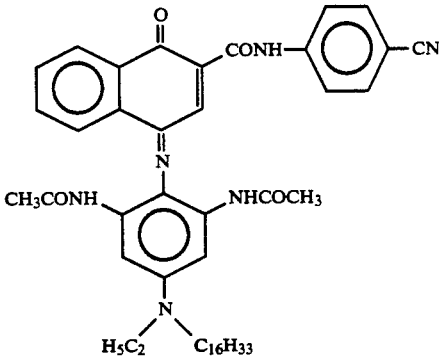
(33)
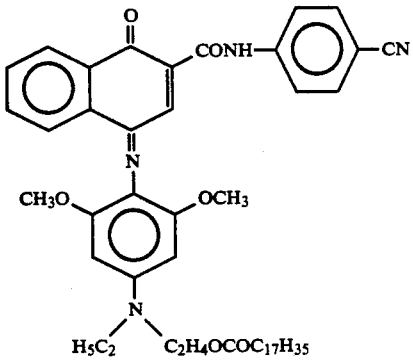
(34)
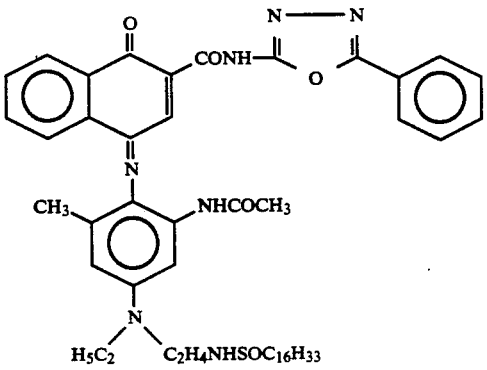

-continued
(35)
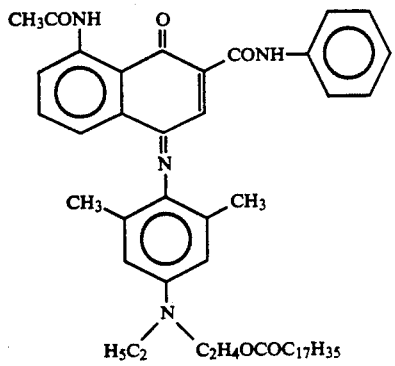
(36)
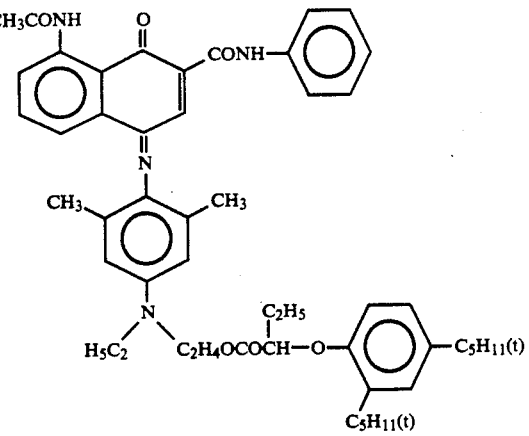
(37)
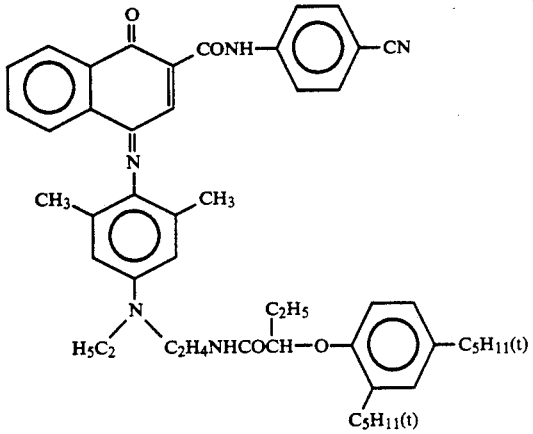
(38)
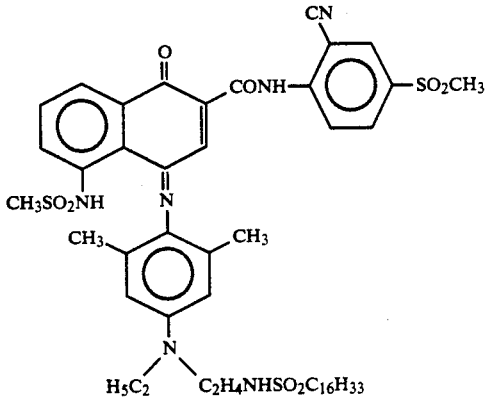
(39)
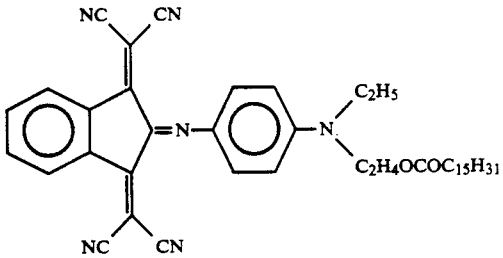
(40)
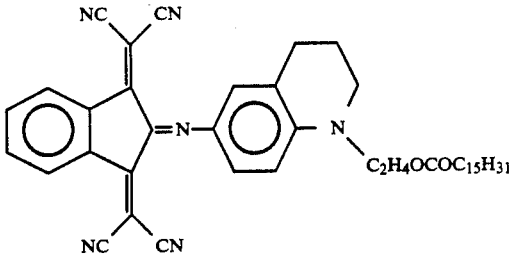
(41)
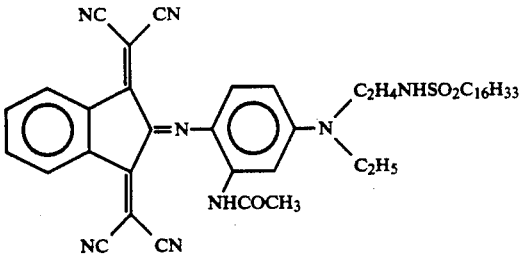
(42)
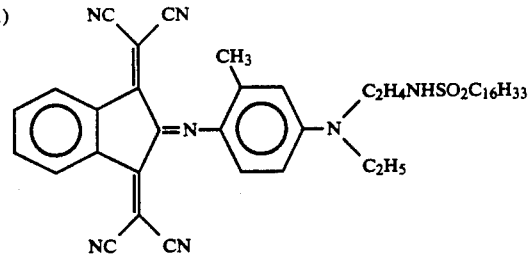
(43)
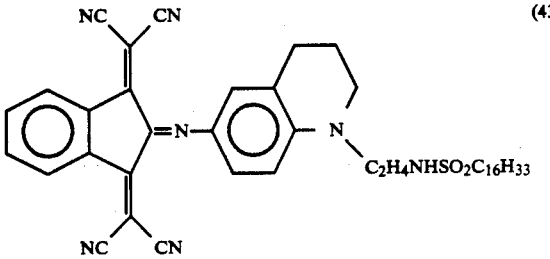
(44)
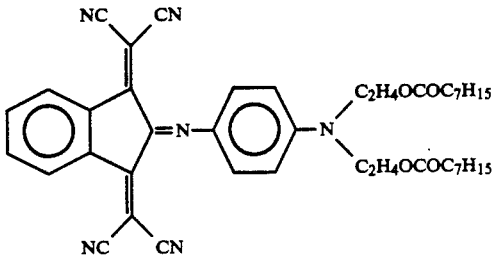

-continued
(45)
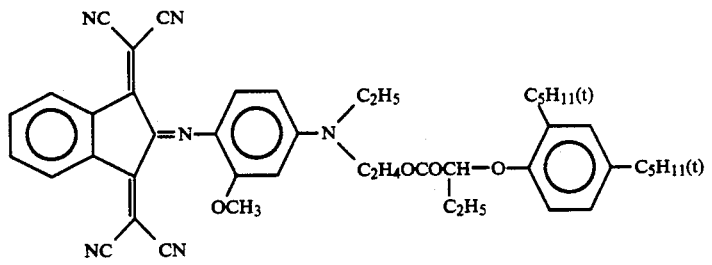
(46)
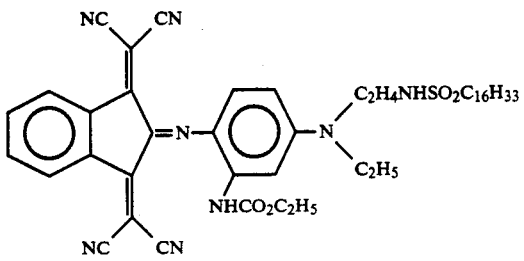
(47)
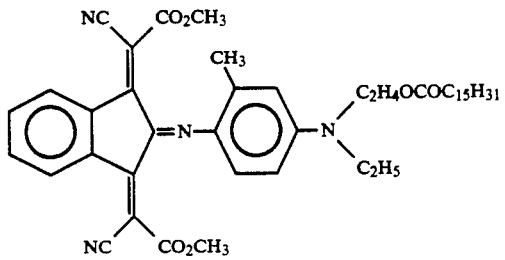
(48)
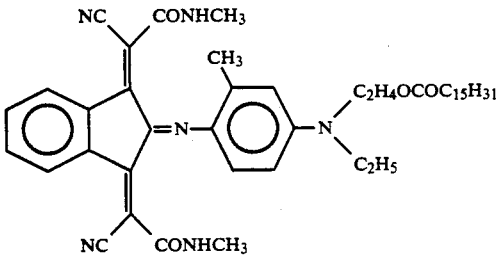
(49)
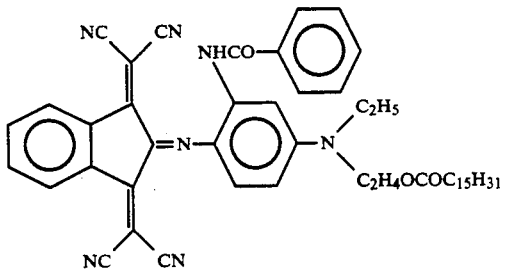
(50)
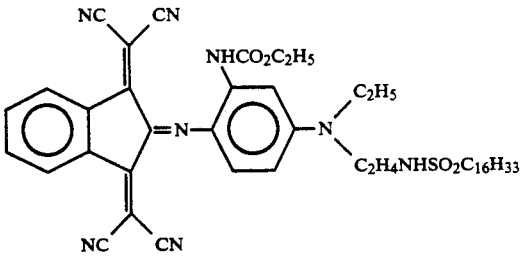
(51)
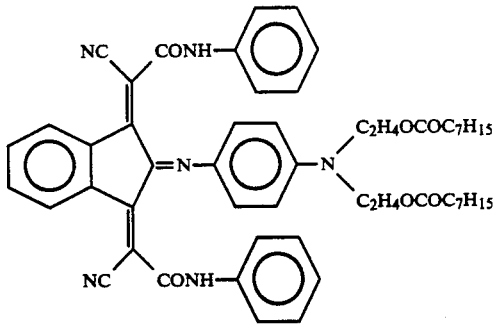
(52)
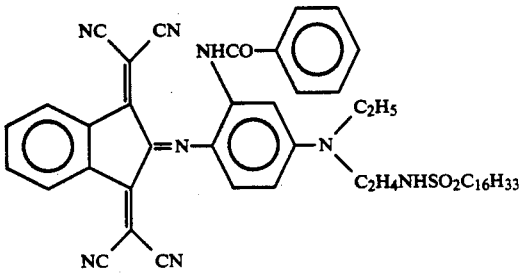
(53)
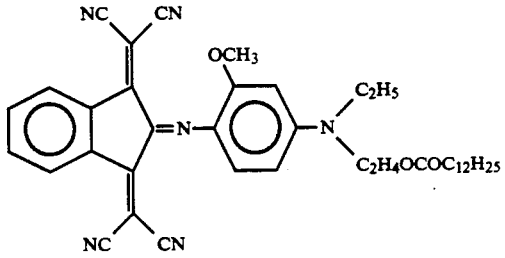

-continued (54)

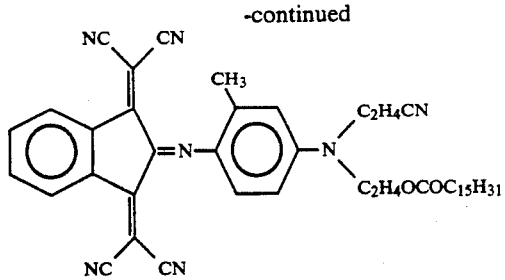

(55)

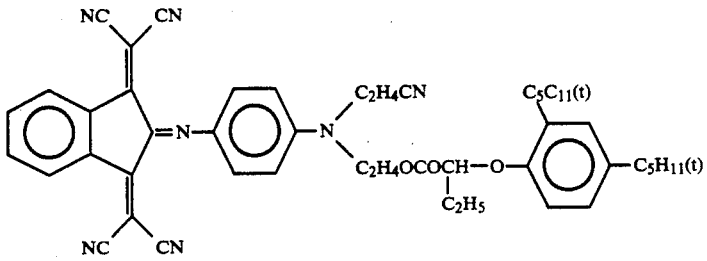

(56)

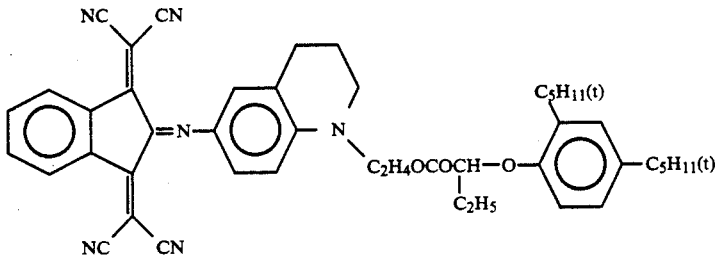

(57)

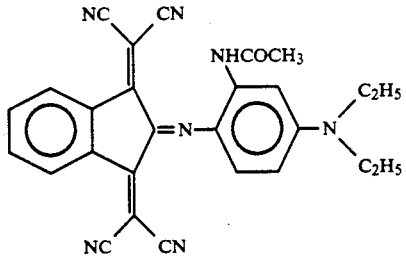

(58)

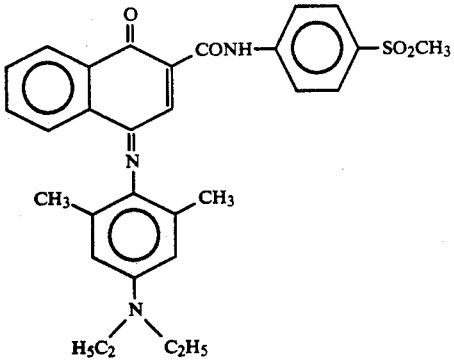

(59)

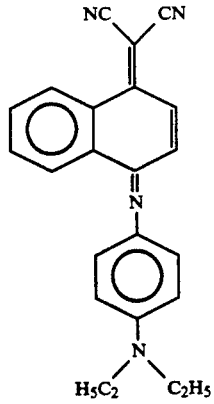

A method for synthesizing the infrared-absorbing dye of the present invention is described below.

The infrared-absorbing dye of the present invention represented by Formula (I) can be synthesized by the method in which 1-dicyanomethylnaphthalene and derivatives thereof are oxidatively coupled with p-phenylenediamines and the method in which 1-dicyanomethylnaphthalene and derivatives thereof are dehydrated and condensed with 4-nitroso-N,N-disubstituted anilines. The latter method is better in terms of providing a high yield.

SYNTHESIS EXAMPLE 1

Synthesis of Infrared-Absorbing Dye 59

A solution prepared by dissolving 3.84 g of 1-dicyano-methylnaphthalene and 4.70 g of 3-acetylamino-4-nitroso-N,N-diethylaniline in 30 ml of acetonitrile was charged into a reaction vessel, and then 10 ml of pyridine were added thereto. Further, 5 ml of anhydrous acetic acid were added dropwise, followed by stirring at room temperature for one hour. The reaction solution was poured into cold water and extracted with ethyl acetate. The extracted solution was washed with water and dried, and then the solution was distilled off. A small amount of acetonitrile was added to the residue, and the precipitated crystal was filtered and then recrystallized from a mixed solvent of ethyl acetate and n-hexane to obtain the dark green crystal of the infrared-absorbing dye (59).

λmax (chloroform): 773 nm. ε: $3.1 \times 10^4$.

The other dyes of Formula (I) of the present invention can be synthesized as well in the same manner as set forth above.

The infrared-absorbing dye of the present invention represented by Formula (II) can be synthesized by the method in which 1-hydroxy-2-naphthoic acid anilides are oxidatively coupled with p-phenylenediamines and the method in which 1-hydroxy-2-naphthoic acid anilides are dehydrated and condensed with p-nitroso-N,N-disubstituted anilines. The latter method is better in terms of providing a high yield.

SYNTHESIS EXAMPLE 2

Synthesis of Infrared-Absorbing Dye 58

A mixture of 26.3 g of 1-hydroxy-2-naphthoic acid anilide, 20.6 g of 3,5-dimethyl-4-nitroso-N,N-diethylaniline and 300 ml of ethanol was charged into a reaction vessel and heated for dissolving. Then, the mixture was cooled to room temperature, and 20 ml of anhydrous acetic acid were added dropwise at room temperature, followed by stirring at 50° C. for 3 hours under heating. After leaving the solution at room temperature, the solvent was distilled off under a reduced pressure. Then, 100 ml of ethyl acetate were added thereto, after which the solution was left at room temperature. The precipitated crystals were filtered and then recrystallized from acetonitrile to obtain 18.5 g of brilliant green crystals of the infrared-absorbing dye (58).

λmax (chloroform). 758 nm. ε: $1.34 \times 10^4$.

The other dyes of Formula (II) can be synthesized as well in the same manner as set forth above.

The infrared-absorbing dye of the present invention represented by Formula (III) can be synthesized by the method in which the 1,3-dimethylene-indane derivatives prepared by reacting 1,3-indanedione with an active methylene compound are dehydrated and condensed with 4-nitroso-N,N-disubstituted anilines.

SYNTHESIS EXAMPLE 3

Synthesis of Infrared-Absorbing Dye 57

2.42 g of 1,3-bis-dicyanomethyleneindane, 2.35 g of 3-acetylamino-4-nitroso-N,N-diethylaniline and 40 ml of anhydrous acetic acid were charged into a reaction vessel, and the mixture was stirred at room temperature for 30 minutes. The precipitated crystals were filtered and then recrystallized from a mixed solvent of ethyl acetate and n hexane to obtain 1.6 g of dark green crystals of the infrared-absorbing dye (57).

λmax (chloroform): 795 nm. ε: $4.0 \times 10^4$.

The other dyes of Formula (III) can be prepared as well in the same manner as set forth above, with the reaction solvents being suitably selected.

Conventional materials can be used for the support of the heat transfer dye-providing material of the present invention. Examples thereof are polyethylene terephthalate, polyamide, polycarbonate, glassine paper, condenser paper, cellulose ester, fluorinated polymer, polyether, polyacetal, polyolefin, polyimide, polyphenylene sulfide, polypropylene, polysulfone, and cellophane.

The thickness of the support for the heat transfer dye-providing material is generally 2 to 30 μm. A subbing layer may be provided if necessary.

The heat transfer dye-providing material containing a thermally immigrating dye basically comprises a support having provided thereon a dye-providing layer containing a dye which becomes mobile by heating and a binder. This heat transfer dye-providing material can be prepared by applying a coating solution on one side of a conventional support for the heat transfer dye-providing material in an amount which gives a dry thickness of, for example, about 0.2 to 5 μm, preferably 0.4 to 2 μm, to thereby form a dye-providing layer, wherein the coating solution is prepared by dissolving or dispersing a conventional dye which sublimes or becomes mobile by heating and a binder in an appropriate solvent.

The solvents for dissolving or dispersing the above-described dye and binder can be conventional ink solvents, and examples of such solvents include an alcohol such as methanol, ethanol, isopropyl alcohol, n-butanol and isobutanol, a ketone such as methyl ethyl ketone, methyl isobutyl ketone and cyclohexanone, an aromatic solvent such as toluene and xylene, a halogenated hydrocarbon such as dichloromethane, and trichloroethane, dioxane, tetrahydrofuran and the like, and a mixture thereof.

The dye-providing layer may be a single layer structure, or it may have a structure of two or more layers so that the heat transfer dye-providing material can be applied many times, wherein the respective layers may have the different dye contents and dye/binder ratios.

Any dyes which are conventionally used for a heat transfer dye-providing material can be used as the dye useful for forming such a dye-providing layer. Of them, dyes having a molecular weight as small as about 150 to 800 are particularly preferred in the present invention, and the dyes are selected in view of transfer temperature, hue, light fastness, dissolving property and dispersibility in an ink and a binder.

Examples thereof are a dispersion dye, a basic dye and an oil-soluble dye. Of them, Sumikaron Yellow E4GL, Dianics Yellow H2G-FS, Miketon Polyester Yellow 3GSL, Kayaset Yellow 937, Sumikaron Red EFBL, Dianics Red ACE, Miketon Polyester Red FB, Kayaset Red 126, Miketon First Brilliant Blue B, and Kayaset Blue 136 are preferably used.

Further, the yellow dye represented by the following Formula (Y) is preferably used:

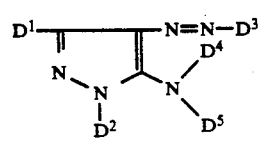

(Y)

wherein $D^1$ represents a hydrogen atom, an alkyl group, an alkoxy group, an aryl group, an alkoxycarbonyl group, a cyano group, or a carbamoyl group; $D^2$ represents a hydrogen atom, an alkyl group, or an aryl group;

$D^3$ represents an aryl group or a heteroaryl group; $D^4$ and $D^5$ each represent a hydrogen atom or an alkyl group; and each of the above groups may be substituted.
Examples of the yellow dye are shown below:
Y-1
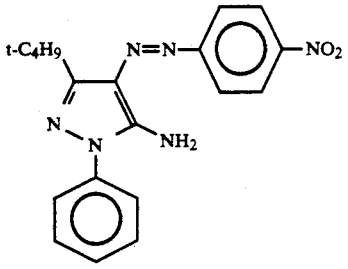
Y-2
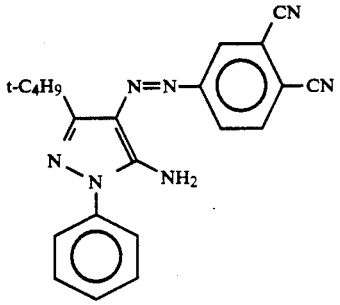
Y-3
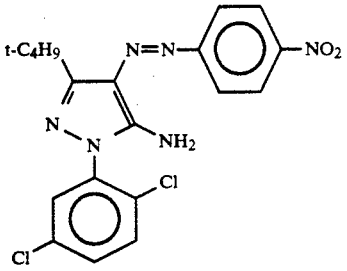
Y-4
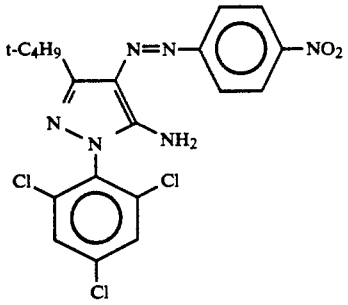
Y-5
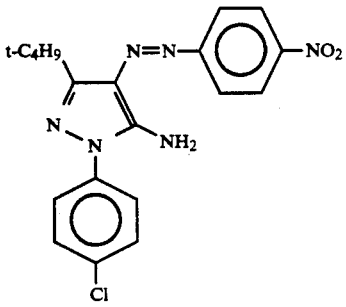
-continued
Y-6
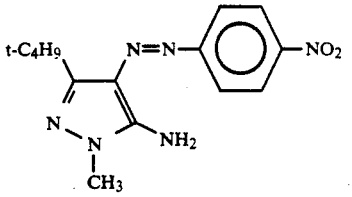
Y-7
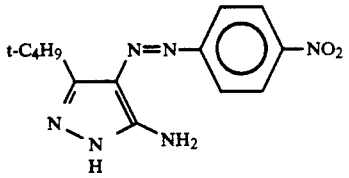
Y-8
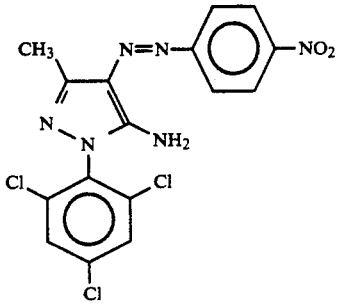
Y-9
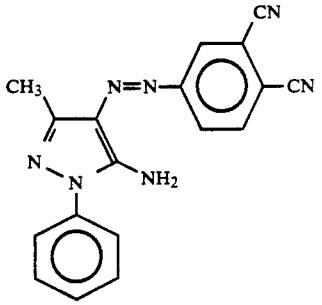
Y-10
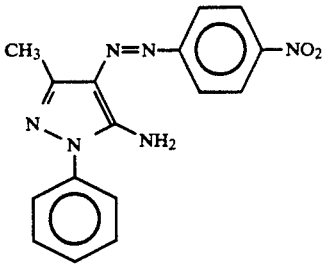
Y-11
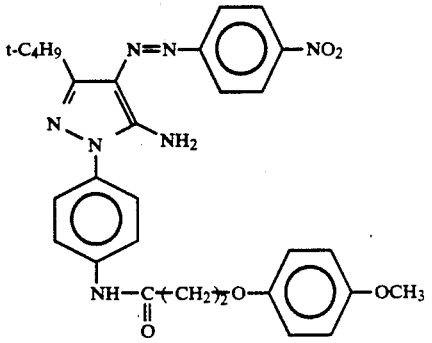

The dye represented by the following Formula (M) is preferred as a magenta dye:

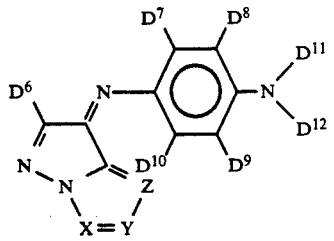

(M)

wherein $D^6$ to $D^{10}$ each represent a hydrogen atom, a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl hydrogen atom, an alkyl group, or an aryl group, provided that $D^{11}$ and $D^{12}$ may be combined with each other to form a ring and that $D^8$ and $D_{11}$ and/Or $D^9$ and $D^{12}$ may be combined with each other to form a ring; X, Y and Z each represent a nitrogen atom and $$=\overset{\overset{D^{13}}{|}}{C}-,$$

in which $D^{13}$ represents a hydrogen atom, an alkyl group, an aryl group, an alkoxy group, an aryloxy group, or an amino group, provided that when X and Y or Y and Z are $$=\overset{\overset{D^{13}}{|}}{C}-,$$

the two $D^{13}$s may be combined wit saturated or unsaturated carbon ring; and each of the above groups may be substituted.

Examples of the magenta dye are shown below:

M-1

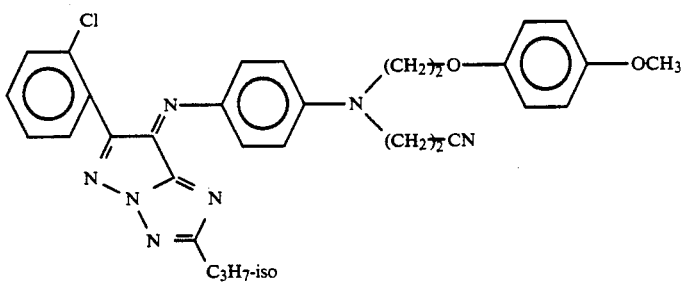

M-2

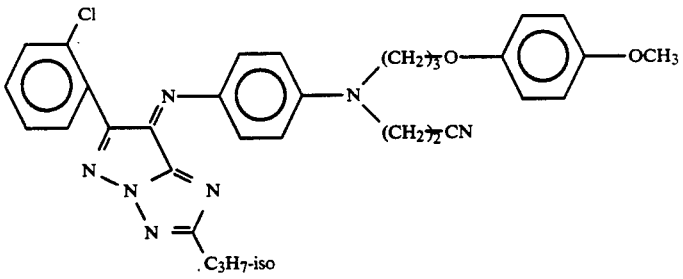

M-3

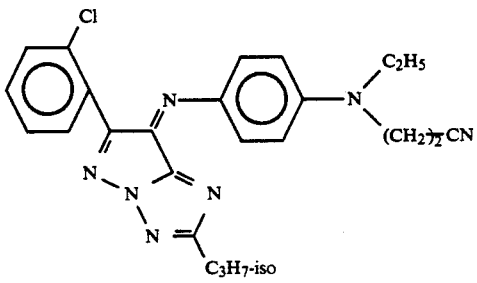

-continued
M-4
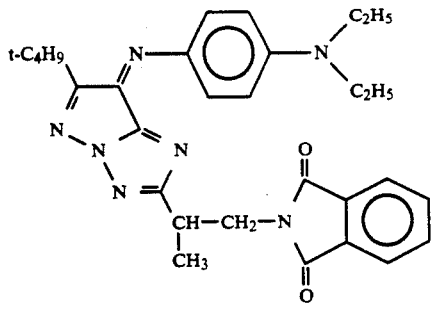
M-5
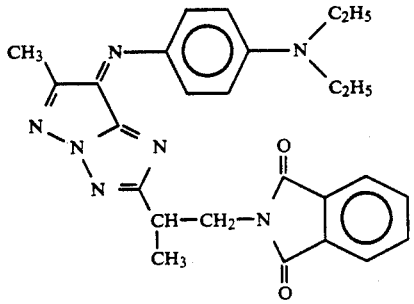
M-6
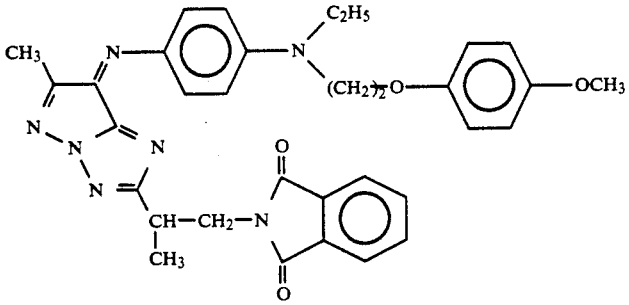
M-7
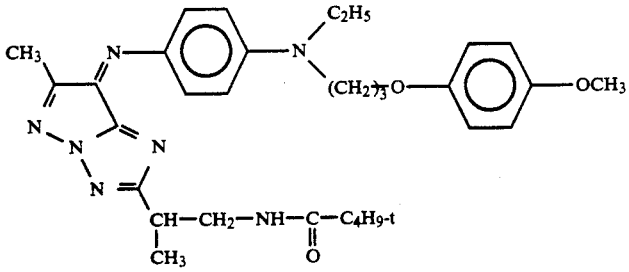
M-8
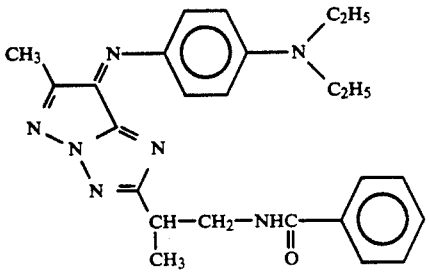

-continued
M-9
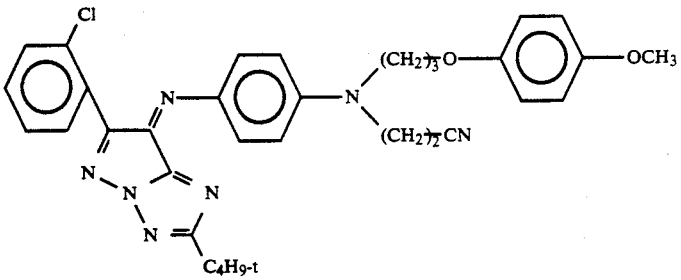
M-10
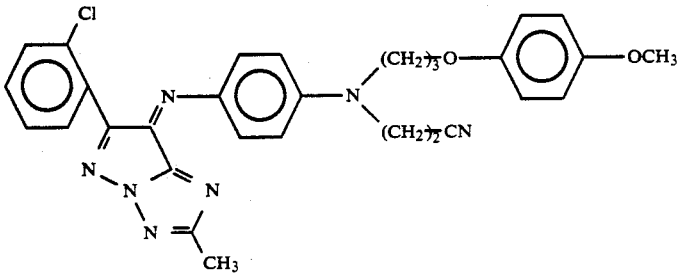
The dye represented by the following Formula (C) is preferable as a cyan dye:
(C)
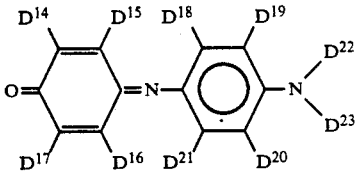
wherein $D^{14}$ to $D^{21}$ each represent the same groups as those defined above for $D^{6}$ to $D^{10}$; and $D^{22}$ and $D^{23}$ each represent the same groups as those defined above for $D^{11}$ and $D^{12}$.
Examples of the cyan dye are shown below:
C-1
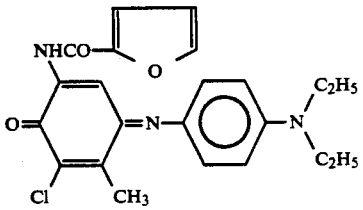
C-2
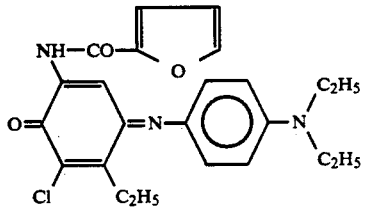
-continued
C-3
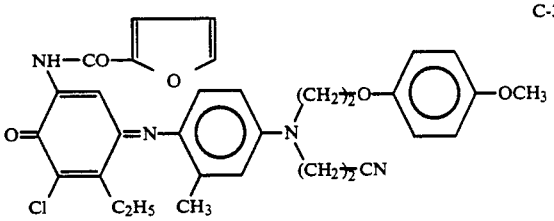
C-4
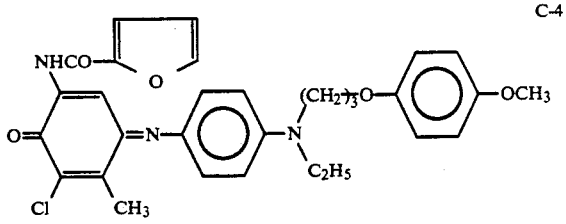
C-5
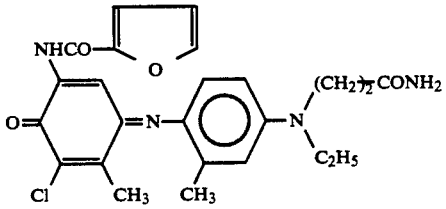
C-6
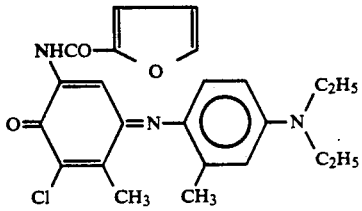

-continued

C-7

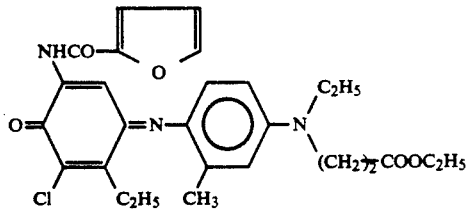

C-8

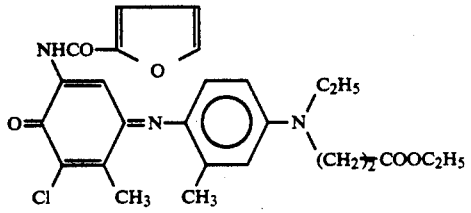

C-9

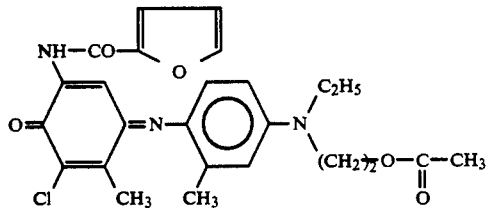

The compounds in which an anti-fading group described in Japanese Patent Application 1-271078 is introduced into the compounds represented by above Formulas (Y), (M) and (G) are preferable because light fastness can be improved.

Any conventional binder resins known to be useful for such purpose as that of the present invention can be used in combination with the above dyes. Usually, the binder resins which have a high thermal resistance and in addition do not prevent the dyes from transferring during heating are selected. Examples of the resins used in the present invention are a polyamide resin, a polyester resin, an epoxy resin, a polyurethane resin, a polyacrylic resin (for example, polymethyl methacrylate, polyacrylamide, and polystyrene-2-acrylonitrile), a vinyl resin including polyvinylpyrrolidone, a polyvinylchloride resin (for example, a copolymer of vinylchloride-vinyl acetate), a polycarbonate resin, polystyrene, polyphenylene oxide, a cellulose resin (for example, methylcellulose, ethylcellulose, carboxymethylcellulose, cellulose acetate biphthalate, cellulose acetate, cellulose acetate propionate, cellulose acetate butylate, and cellulose triacetate), a polyvinyl alcohol resin (for example, polyvinyl alcohol and a partially saponified polyvinyl alcohol such as polyvinyl butyral), a petroleum resin, a rosin derivative, a cumarone-indene resin, a terpene resin, and a polyolefin resin (for example, polyethylene and polypropylene).

These binders are used preferably in a ratio of from about 80 to about 600 parts by weight per 100 parts by weight of a dye.

In the present invention, the above-described conventional ink solvents can be arbitrarily used as the ink solvent for dissolving or dispersing the above dyes.

The dye-providing material may be provided with a hydrophilic dye-barrier layer in order to prevent the dyes from diffusing toward the support. The hydrophilic dye-barrier layer contains a hydrophilic compound useful for the intended purpose. In general, excellent results can be obtained with gelatin, polyacrylamide, polyisopropylacrylamide, butyl methacrylate-grafted gelatin, ethyl methacrylate-grafted gelatin, cellulose monoacetate, methylcellulose, polyvinyl alcohol, polyethyleneimine, polyacrylic acid, a mixture of polyvinyl alcohol and polyvinyl acetate, a mixture of polyvinyl alcohol and polyacrylic acid, and a mixture of cellulose monoacetate and polyacrylic acid. Of these hydrophilic compounds, polyacrylic acid, cellulose monoacetate and polyvinyl alcohol are particularly preferred.

The dye-providing material may be provided with a subbing layer. In the present invention, any material can be used for the subbing layer as long as it can provide the desired effect. Preferred examples thereof are a copolymer of acrylonitrile, vinylidene chloride and acrylic acid (14:80:6 by weight), a copolymer of butyl acrylate, 2-aminoethyl methacrylate and 2-hydroxyethyl methacrylate (30:20:50 by weight), a linear, saturated polyester (for example, Bostic 7650 manufactured by Emhart Co., Bostic Chemical Group), and a chlorinated high-density polyethylenetrichloroethylene resin. The coated amount of the subbing layer is not specifically limited. Usually it is from about 0.1 to about 2.0 $g/m^2$.

In the dye-providing layer, the dye is selected so that the transfer can be carried out at a desired hue in printing, and if necessary, two or more dye-providing layers, each containing a different dye, may be formed in order on the heat transfer dye-providing material. For example, where printing of each color is repeated according to the signals of the separated colors to form an image like a color photo, the hue of a printed image comprises preferably cyan, magenta and yellow, and three dye-providing layers containing the dyes capable of giving such hue are provided. Alternatively, in addition to cyan, magenta and yellow, a dye-providing layer containing a dye capable of giving a black hue may be added. It is preferred to provide the dye-providing material with a mark for detecting a position. The mark is preferably formed by multi-color gravure printing simultaneously with the formation of the dye-providing layers on the supports. The mark can be any material as long as it can be detected by an electric, magnetic or optical means as disclosed in JP-A-1-202491.

In the present invention, any support can be used for the heat transfer image-receiving material as long as it can endure a transfer temperature and satisfy the requirements of smoothness, whiteness, sliding property, frictional property, anti-electrification, and dimpling after transferring. Examples thereof are a paper support such as a synthetic paper (e.g., synthetic papers of polyolefin and polystyrene), a woodfree paper, an art paper, a coat paper, a cast-coated paper, a wall paper, a backing paper, a synthetic resin or emulsion-impregnated paper, a synthetic rubber latex-impregnated paper, a synthetic resin-lining paper, a board paper, a cellulose fiber paper, and a polyolefin-coated paper (in particular, a paper coated on both sides with polyethylene); various plastic films or sheets of polyolefin, polyvinyl chloride, polyethylene terephthalate, polystyrene, polymethacrylate, and polycarbonate, and films or sheets thereof each subjected to the processing for providing a white color reflectiveness; and laminated materials comprising combination of the above materials.

The heat transfer image-receiving material is provided with an image-receiving layer. This image-receiving layer is preferably a layer containing singly or in combination with the other binders a substance capable of receiving a thermally immigrating dye transferring from the heat transfer dye-providing material during printing and having a function of fixing the dye therein. The thickness thereof is preferably on the order of from about 0.5 to about 50 μm.

Examples of polymers which are typical substances capable of receiving the thermally immigrating dyes are as follows:

(1) Polymers having an ester bond:

A polyester resin obtained by condensing a dicarboxylic acid component such as terephthalic acid, isophthalic acid or succinic acid (these dicarboxylic acid components may be substituted with a sulfonic acid group or a carboxylic acid group) with ethylene glycol, diethylene glycol, propylene glycol, neopentyl glycol or bisphenol A; a polyacrylate resin and a polymethacrylate resin such as polymethyl methacrylate, polybutyl methacrylate, polymethyl acrylate or polybutyl acrylate; a polycarbonate resin; a polyvinyl acetate resin; a styrene-acrylate resin; and a vinyltoluene-acrylate resin. Examples thereof are described in more detail in JP-A-59-101395, JP-A-63-7971, JP-A-63-7972, JP-A-63-7973, and JP-A-60-294862. Commercially available products include Vylon 290, Vylon 200, Vylon 280, Vylon 300, Vylon 103, Vylon GK-140, and Vylon GK-130, each manufactured by Toyobo Co., and ATR-2009 and ATR-2010, each manufactured by Kao Corporation.

(2) Polymers having a urethane bond, such as a polyurethane resin.

(3) Polymers having an amide bond, such as a polyamide resin.

(4) Polymers having a urea bond, such as a urea resin.

(5) Polymers having a sulfone bond, such as a polysulfone resin.

(6) Other polymers having a high-polar bond, such as a polycaprolactone resin, a styrene-maleic anhydride resin, a polyvinyl chloride resin, and a polyacrylonitrile resin.

In addition to the above synthetic resins, mixtures of these polymers or copolymers thereof can be used as well.

A high boiling solvent or a hot-melt solvent which can be used as the substance capable of receiving the thermally immigrating dye or as a dispersion aid can be incorporated into the heat transfer image-receiving material, particularly into the image-receiving layer.

Examples of the high boiling solvent and hot-melt solvent are the compounds described in JP A 62-174754, JP-A-62-245253, JP-A-61-209444, JP-A-61-200538, JP-A-62-8145, JP-A-62-9348, JP-A-62-30247, and JP-A-62-136646.

In the present invention, the image-receiving layer of the heat transfer image-receiving material may be of a structure in which the substance capable of receiving the thermally immigrating dye dispersed in a water soluble binder is applied. The water soluble binders used in this case may be various conventional polymers. The water soluble polymers having a group capable of undergoing a crosslinking reaction with a hardener are preferable. Of these water soluble polymers, gelatins are particularly preferable.

The image-receiving layer may be composed of two or more layers, wherein the layer closer to the support is preferably of the structure in which a synthetic resin having a lower glass transition point, a high-boiling solvent and a hot-melt solvent are used to increase the dyeing property; and the outermost layer is preferably of the structure in which a synthetic resin having a higher glass transition point, a high-boiling solvent and a hot-melt solvent are used in a necessary minimum amount or not at all to prevent problems such as adhesiveness on a surface, sticking to the other materials, retransfer to the other materials after transfer, and blocking with the heat transfer dye-providing material.

The total thickness of the image-receiving layer is preferably about 0.5 to 50 μm, particularly 3 to 30 μm. Where the image-receiving layer is of the two layer structure, the thickness of the outermost layer is preferably about 0.1 to 2 μm, particularly 0.2 to 1 μm.

In the present invention, the heat transfer image-receiving material may be provided with an intermediate layer between the support and an image-receiving layer.

The intermediate layer functions as at least one of a cushion layer, a porous layer and a dye diffusion-preventing layer, and in certain occasions, it also functions as an adhesive.

The dye diffusion-preventing layer has the function, in particular, of preventing the thermally immigrating dye from diffusing to the support. The binder constituting this diffusion-preventing layer may be either water-soluble or organic solvent-soluble. A water soluble binder is preferable, and examples thereof are the same ones as those defined for the binders for the image-receiving layer. Of these water soluble binders, gelatin is particularly preferable.

The porous layer has the function of preventing the heat applied in heat transfer from diffusing to the support in order to efficiently utilize the applied heat.

In the present invention, an image-receiving layer, a cushion layer, a porous layer, a diffusion-preventing layer and an adhesive layer each constituting the heat transfer image-receiving material may contain fine powders such as silica, clay, talc, diatomaceous earth, calcium carbonate, calcium sulfate, barium sulfate, aluminium silicate, synthetic zeolite, zinc oxide, lithopone, titanium oxide, and alumina.

A fluorescent whitening agent may be used for the heat transfer image-receiving material. Examples thereof are the compounds described in "The Chemistry of Synthetic Dyes" edited by K. Veenkataraman, Vol. 5, Chapter 8, and JP-A-61-143752. Specific examples are a stilbene compound, a coumarin compound, a biphenyl compound, a benzoxazolyl compound, a naphthalimide compound, a pyrazoline compound, a carbostyryl compound, and 2,5-dibenzoxazolthiophene compound.

A fluorescent whitening agent can be used in combination with an anti-fading agent.

In the present invention, in order to improve the releasing properties of the heat transfer dye-providing material and the heat transfer image-receiving material, a releasing agent is incorporated preferably into the layers constituting the dye-providing material and/or the image-receiving material, particularly preferably into the outermost layers on which both materials are contacted.

As the releasing agent, any of the conventional releasing agents, such as solid or wax substances including fine powders of polyethylene wax, amide wax and a silicon resin, and a fine powder of a fluorinated resin; fluorine type and phosphate type surfactants; and paraffin type, silicone type and fluorine type oils, can be used. Of these releasing agents, a silicone oil is particularly preferred.

As a silicone oil, the modified silicone oils of a carboxy modification, an amino modification, an epoxy modification, a polyether modification, and an alkyl modification, in addition to the non-modified ones, can be used. They can be used singly or in combination with each other. Examples thereof are various modified silicone oils described on pages 6 to 18B of the technical document "Modified Silicone Oil", published by Shin-Etsu Chemical Co., Ltd. Where they are used in an organic solvent type binder, an amino-modified silicone having a group capable of reacting with a crosslinking agent of this binder (for example, a group capable of reacting with isocyanate) is effective; and where they are used by being emulsified and dispersed in a water-soluble binder, a carboxy-modified silicone oil (for example, the brand X-22-3710, manufactured by Shin-Etsu Chemical Co., Ltd.) or an epoxy-modified silicone oil (for example, the brand XF-100T, manufactured by Shin-Etsu Chemical Co., Ltd.) is effective.

The layers constituting the heat transfer dye-providing material and the heat transfer image-receiving material used in the present invention may be hardened with a hardener.

Where an organic solvent type polymer is hardened, the hardeners described in JP-A-61-199997 and JP-A-58-215398 can be used. In particular, an isocyanate type hardener is preferably used for a polyester resin.

In hardening a water-soluble polymer, the hardeners described in column 41 of U.S. Pat. No. 4,678,739, and in JP-A-59-116655, JP-A-62-245261 and JP-A-61-18942 can be used. Specific examples the an aldehyde type hardener (e.g., formaldehyde), an aziridine type hardener, an epoxy type hardener

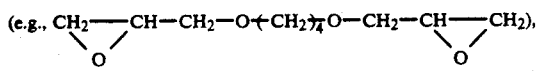

(e.g., $CH_2(O)CH-CH_2-O-(CH_2)_4-O-CH_2-CH(O)CH_2$), a vinylsulfone type hardener (e.g., N,N'-ethylene-bis-(vinylsulfonylacetoamide) ethane), an N-methylol type hardener (e.g., dimethylol urea), and a polymer hardener (e.g., the compounds described in JP-A-62-234157).

An anti-fading agent may be used for the heat transfer dye-providing material and the heat transfer image-receiving material. Examples of the anti-fading agent are an anti-oxidation agent, a UV absorber and a metal complex.

Examples of the anti-oxidation agent are a chroman type compound, a coumaran type compound, a phenol type compound (e.g., hindered phenols), a hydroquinone derivative, a hindered amine derivative, and a spiroindane type compound. Further, the compounds described in JP-A-61-159644 are effective as well.

Examples of the UV absorber are a benzotriazole type compound (U.S. Pat. No. 3,533,794), a 4-thiazolidone type compound (U.S. Pat. No. 3,352,681), a benzophenone type compound (JP-A-56-2784), and compounds described in JP-A-54-48535, JP-A-62-136641 and JP-A-61-88256. Also, a UV absorptive polymer described in JP-A-62-260152 is effective.

Examples of the metal complex are the compounds described in U.S. Pat. Nos. 4,241,155, 4,245,018 (columns to 36), and 4,254,195 (columns 3 to 8), and JP-A-62-74741, JP-A-61-88256 (pages 27 to 29), JP-A-1-75568, and JP-A-63-199248.

Examples of a useful anti-fading agent are described in JP-A-62-215272 (pages 125 to 137). The anti-fading agent used for preventing a dye transferred to an image-receiving material from fading may be incorporated in advance into the image-receiving material or may be supplied to the image-receiving material from the outside by a method such as transferring the anti-fading agent from the dye-providing material.

The above anti-oxidation agent, UV absorber and metal complex may be used in combination with each other.

Various surfactants can be used in the component layers of the heat transfer dye-providing material and the heat transfer image-receiving material as coating aids and for improving peeling and sliding properties, anti-electrification and the promotion of development.

Also, a nonionic surfactant, an anionic surfactant, an amphoteric surfactant and a cationic surfactant can be used. Examples thereof are described in JP-A-62-173463 and JP-A-62-183457.

Further, in dispersing a substance capable of receiving a thermally immigrating dye, a releasing agent, an anti-fading agent, a UV absorber, a fluorescent whitening agent, and other hydrophobic compounds in a water-soluble binder, a surfactant is preferably used as a dispersion aid. For this purpose, the surfactants described in JP-A-59-157636 (pages 37 to 38) are particularly preferably used in addition to the above surfactants.

A matting agent can be used for the heat transfer dye-providing material and the heat transfer image-receiving material. Examples of the matting agent are the compounds described in JP-A-63-274944 and JP-A-63-274952, such as benzoguanamine resin beads, polycarbonate resin beads and styrene-acrylonitrile copolymer resin beads, in addition to the compounds described in JP-A-61-88256 (page 29), such as silicon dioxide, polyolefin and polymethacrylate.

As described above, the dye-providing material of the present invention is used in a process to form a transferred image. Such a process comprises the steps of heating imagewise the dye-providing material with a laser and transferring a dye image to the image-receiving material to form a transferred image, as described above.

The dye-providing material of the present invention is used in a sheet form, a continuous roll or a ribbon. Where it is used in a continuous roll or a ribbon, it contains only one kind of a dye or has separate areas containing different dyes, such as cyan and/or magenta and/or yellow and/or black and other dyes. That is, the materials of one color, two colors, three colors and four colors (or the materials of more colors) fall within the scope of the present invention.

In a preferable embodiment of the present invention, the dye-providing material comprises a support of polyethylene terephthalate having coated thereon layers containing a cyan dye, a magenta dye and a yellow dye in order; and the steps previously described are carried out one by one for each color to form a transferred image of three colors. In the embodiment carrying out this procedure in a single color, a monochromatic transferred image is obtained.

For the purpose of heat-transferring a dye from the dye-providing material to the image-receiving material, several kinds of lasers can be used, such as an ion gas laser including argon and krypton lasers, a metal vapor laser including copper, gold and cadmium lasers, a solid laser including ruby and YAG lasers, and a semiconductor laser including a gallium-arsenic laser emitting light in an infrared region of 750 to 870 nm. Of these lasers, the semiconductor laser is practicably favorable in terms of compactness, lower cost, stability, reliability, durability and ease in modulation. In order to have a laser useful for heating the dye-providing material, the laser light has to be absorbed in a layer containing an infrared-absorbing dye and converted to heat through a molecular process known as an inner conversion. For this purpose, a laser which emits a light having a wavelength to be absorbed by the infrared-absorbing dyes, preferably a wavelength of from about 750 nm to about 900 nm can be used. The laser which emits a light of the above wavelength is known as an infrared laser and, mainly can be selected from semiconductor lasers. Lasers capable of being used for transferring a dye from the dye-providing material of the present invention are commercially available.

The present invention is further described by the following examples, which should not be construed as limiting the present invention in any way. All parts, percents, ratios and the like are by weight unless otherwise indicated.

EXAMPLE 1

Inks for forming the dye-providing layers having the following compositions were coated on a 6 μm thick support of a polyester film manufactured by Teijin Co., Ltd in the coated amount of 1.2 g/m$^2$ after drying, whereby the dye-providing material was obtained.

| Composition of the dye-providing layer-forming cyan ink | |
|---|---|
| Compound (1) (an infrared-absorbing dye) | 2.2 parts |
| Dye-a | 3 parts |

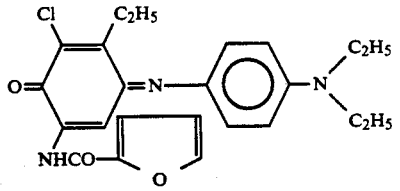

| | |
|---|---|
| Polyvinyl butyral resin (Denka Butyral 5000A, manufactured by Denki Chemical Co., Ltd.) | 2.5 parts |
| Polyisocyanate (Takenate D110N manufactured by Takeda Industry Co., Ltd.) | 0.1 parts |
| Amino-modified silicone oil (KF-857 manufactured by Shin-Etsu Chemical Co., Ltd.) | 0.004 part |
| Methyl ethyl ketone | 50 parts |
| Toluene | 50 parts |

| Composition of the dye-providing layer-forming magenta ink | |
|---|---|
| Compound (21) (an infrared-absorbing dye) | 2 parts |
| Dye-b | 2.5 parts |

-continued

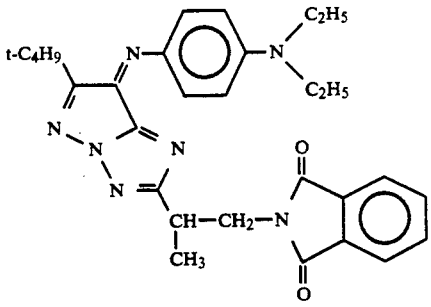

| | |
|---|---|
| Polyvinyl butyral resin (Eslex BX-1, manufactured by Sekisui Chemical Co., Ltd.) | 2.5 parts |
| Polyisocyanate (KP-90, manufactured by Dainippon Ink Chemical Co., Ltd.) | 0.1 part |
| Silicone oil (KF-857 manufactured by Shin-Etsu Chemical Co., Ltd.) | 0.004 part |
| Methyl ethyl ketone | 70 parts |
| Toluene | 30 parts |

| Composition of the dye-providing layer-forming yellow ink | |
|---|---|
| Compound (39) (an infrared absorbing dye) | 1.5 parts |
| Dye-c | 5 parts |

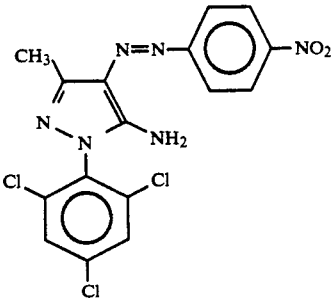

| | |
|---|---|
| Ethyl cellulose | 3 parts |
| Methyl ethyl ketone | 50 parts |
| Toluene | 50 parts |

PREPARATION OF THE HEAT TRANSFER IMAGE-RECEIVING MATERIAL (1)

The image-receiving layer-coating components of the following composition were applied on a support of 150 μm thick synthetic paper by a wire-bar coating method so that the dry thickness was 8 μm, whereby the heat transfer image-receiving material (1) was prepared. After drying incompletely, the drying was carried out in an oven at 100° C. for 30 minutes.

| Image-receiving layer-coating components (1) | |
|---|---|
| Polyester resin (Vylon-200, manufactured by Toyobo Co., Ltd.) | 22 g |
| Polyisocyanate (KP-90, manufactured by Dainippon Ink Chemical Co., Ltd.) | 4 g |
| Amino-modified silicone oil (KF-857, manufactured by Shin-Etsu Chemical Co., Ltd.) | 0.5 g |
| Methyl ethyl ketone | 85 ml |
| Toluene | 85 ml |

The dye-providing material provided on a drum was superposed on the image-receiving material and was fixed with an adhesive tape. Then, this combined material was exposed to focused laser light having a wavelength of 780 nm, and the dye was transferred to the dye-receiving material. The laser light was emitted from a semiconductor laser device SDL-2420-H2 manufactured by Spectra Diode Lab Co., Ltd., in which the spot diameter and the irradiating time were 30 μm and 6 milliseconds, respectively, while the output was 85 mW.

The evaluation of the image formed on the image-receiving material is as follows.

The dye-providing material containing the compound of the present invention formed a clear color image on the image receiving material, and no color stain from an infrared-absorbing dye was observed. The maximum reflection densities measured with a Macbeth densitometer were 2.0 for the red color of a cyan image, 2.2 for the green color of a magenta image and 2.1 for the blue color of a yellow image, indicating that the laser light was effectively absorbed by the infrared-absorbing dye and converted to heat.

EXAMPLE 2

The components for forming an infrared-absorbing layer having the following composition were coated on a polyethylene terephthalate support having a thickness of 25 μm so that the dry thickness of the coated layer became 1.5 μm, thereby forming the infrared-absorbing layer. The inks prepared by removing the infrared-absorbing dyes from the components for forming a dye-providing layer prepared in Example 1 were coated on this infrared-absorbing layer, whereby the dye-providing material of yellow, magenta and cyan was prepared.

| Ink composition for forming an infrared-absorbing layer | |
|---|---|
| Compound (2) (an infrared-absorbing dye) | 2.4 parts |
| Polyvinyl butyral resin (Denka Butyral 5000A, manufactured by Denki Chemical Co., Ltd.) | 2.5 parts |
| Methyl ethyl ketone | 70 parts |
| Toluene | 30 parts |

The dye-providing material thus obtained and the image-receiving material prepared in Example 1 were used to form a transferred image in the same manner as in Example 1. A laser diode SLD301 manufactured by Sony Corp. was used to emit the laser light.

The respective color images were sharp. The maximum reflection densities measured with a Macbeth densitometer were 1.9 for the red color of a cyan image, 2.0 for the green color of a magenta image and 2.0 for the blue color of a yellow image.

EXAMPLE 3

PREPARATION OF THE HEAT TRANSFER IMAGE-RECEIVING MATERIAL (2)

Polyethylene was coated on both sides of a 200 μm thick paper in the thicknesses of 15 μm on one side and 25 μm on the other side to thereby prepare a resin-coated paper. The image-receiving layer-coating components (2) of the following composition were coated on the 15 μm thick polyethylene-coated side of the support with a wire-bar coating method so that the dry thickness thereof became 10 μm, followed by drying, whereby the heat transfer dye-receiving material (2) was prepared.

| Image-receiving layer-coating components (2) | |
|---|---|
| Polyester resin (TP-220, manufactured by Nippon Gosei Kagaku Co., Ltd.) | 25 g |
| Amino-modified silicone oil (KF-857, manufactured by Shin-Etsu Chemical Co., Ltd.) | 0.8 g |
| Polyisocyanate (KP-90, manufactured by Dainippon Ink Chemical Co., Ltd.) | 4 g |
| Methyl ethyl ketone | 100 ml |
| Toluene | 100 ml |

The image-receiving material thus obtained and the dye-providing material prepared in Example 1 were used to form a transferred image in the same manner as in Example 1. The obtained image was sharp and had a high density. The maximum reflection densities measured with a Macbeth densitometer were 1.7 for the red color of a cyan image, 1.8 for the green color of a magenta image and 1.9 for the blue color of a yellow image.

EXAMPLE 4

PREPARATION OF THE HEAT TRANSFER IMAGE-RECEIVING MATERIAL (3)

A dye-receptive polymer solution (B) having the following composition was dispersed in an aqueous gelatin solution (A) of the following composition with a homogenizer, whereby a gelatin dispersion of a dye-receptive material was prepared.

| | |
|---|---|
| Aqueous gelatin solution (A) | |
| Gelatin | 2.3 g |
| Sodium dodecylbenzenesulfonate (5% aqueous solution) | 20 ml |
| Water | 80 ml |
| Dye-receptive polymer solution (B) | |
| Polyester resin (Vylon 300 manufactured by Toyobo Co., Ltd.) | 7.0 g |
| Carboxy-modified silicone oil (X-22-3710 manufactured by Shin-Etsu Chemical Co., Ltd.) | 0.7 g |
| Methyl ethyl ketone | 20 ml |
| Toluene | 10 ml |
| Triphenyl phosphate | 1.5 g |

The solution in which 0.5 g of a fluorinated surfactant (a)

$$C_3F_7SO_2\underset{\underset{C_3H_7}{|}}{N}CH_2COOK$$

was dissolved in 10 ml of a mixed solvent of water and methanol (1:1 by volume) was added to the dispersion thus prepared to thereby prepare a coating composition of the image-receiving layer.

This coating composition was applied on a 150 μm thick synthetic paper (YUPO-SGG-150 manufactured by Ohji Petrochemical Co., Ltd.), the surface of which was subjected to a corona discharge, with a wire bar coating method so that the wet thickness thereof became 75 μm, followed by drying, whereby the heat transfer dye-receiving material (3) was prepared.

The obtained image-receiving material and the dye-providing material prepared in Example 2 were used to form a transferred image in the same manner as Example 2. The obtained image was sharp and had a high density. The maximum reflection densities measured with a Macbeth densitometer were 1.8 for the red color of a cyan image, 2.0 for the green color of a magenta image and 2.1 for the blue color of a yellow image.

EXAMPLE 5

Dye-providing materials were prepared in the same manner as described in Example 1, except that the infrared-absorbing dyes used in the ink composition for dye-providing layers of Example 1 were replaced by the infrared-absorbing dyes shown in Table 1 below. When the dyes of the resulting dye-providing material were transferred to the dye-receiving material in the same manner as described in Example 1, a clear color image having a high color density was obtained on the dye-receiving material. The maximum reflection densities measured with a Macbeth densitometer were shown in Table 1 below.

TABLE 1

| No. | Infrared-absorbing Dye | Color of Ink | Maximum Reflection Density |
|---|---|---|---|
| 1 | Compound (10) | Cyan | 1.9 |
| 2 | Compound (28) | " | 2.0 |
| 3 | Compound (37) | " | 1.8 |
| 4 | Compound (40) | " | 1.9 |
| 5 | Compound (51) | " | 1.9 |
| 6 | Compound (13) | Magenta | 2.1 |
| 7 | Compound (28) | " | 2.2 |
| 8 | Compound (35) | " | 2.0 |
| 9 | Compound (44) | " | 2.1 |
| 10 | Compound (55) | " | 2.2 |
| 11 | Compound (8) | Yellow | 2.0 |
| 12 | Compound (18) | " | 2.1 |
| 13 | Compound (32) | " | 1.9 |
| 14 | Compound (41) | " | 1.8 |
| 15 | Compound (50) | " | 2.0 |

COMPARATIVE EXAMPLE

A dye-providing material was prepared in the same manner as described in Example 1, except that the infrared absorbing-dyes used in the ink compositions for dye-providing layers of Example 1 were replaced by carbon black. When the dyes of the resulting dye-providing material were transferred to the dye-receiving material in the same manner as described in Example 1, the maximum reflection densities measured with a Macbeth densitometer were 1.5 for the red color of a cyan image, 1.7 for the green color of a magenta image and 1.8 for the blue color of a yellow image.

Also, particles of carbon black were adhered to the dye-receiving material and the stain of the image was observed.

While the invention has been described in detail and with reference to specific embodiments thereof, it will be apparent to one skilled in the art that various changes and modifications can be made therein without departing from the spirit and scope thereof.

What is claimed is:

1. A thermal transfer dye-providing material comprising a support having provided thereon a layer containing a thermally migrating dye, wherein at least one of the dye-containing layer and a layer adjacent thereto contains an infrared-absorbing dye represented by Formula (I), (II) or (III):

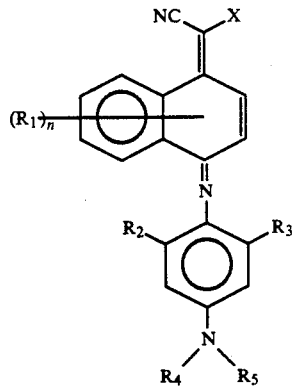

Formula (I)

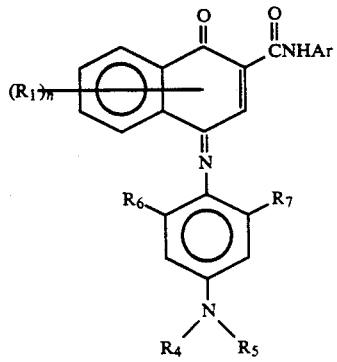

Formula (II)

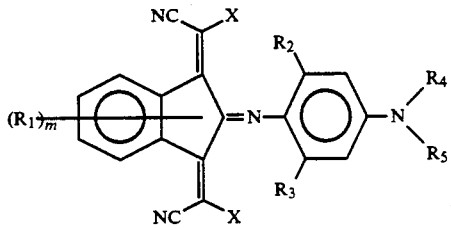

Formula (III)

wherein $R_1$ represents a halogen atom, an alkoxy group, an aryloxy group, an acylamino group, an alkoxycarbonylamino group, a sulfonylamino group, a sulfamoyl group, a hydroxyl group, a sulfonyl group, or a ureido group; n represents an integer of from 0 to 3, provided that $R_1$'s may be the same or different when n is 2 or 3; m represents an integer of from 0 to 2, provided that $R_1$ may be the same or different when m is 2; $R_2$ and $R_3$ can be the same or different and independently represent a hydrogen atom, an alkyl group, an alkoxy group, a halogen atom, an acylamino group, an alkoxycarbonylamino group, or a ureido group; $R_4$ and $R_5$ can be the same or different and independently represent a hydrogen atom, an alkyl group, or an aryl group, provided that $R_4$ and $R_5$ may be combined with each other to form a ring and that $R_4$ and $R_5$ may be combined with a benzene ring to form a 5- or 6-membered nitrogen-containing heterocyclic group; $R_6$ and $R_7$ can be the same or different and independently represent an alkyl group, an alkoxy group, a halogen atom, an acylamino group, an alkoxycarbonylamino group, or a ureido group; X represents a cyano group, an acyl group, an alkoxycarbonylamino group, or a ureido group; Ar represents an aryl group or a heteroaryl group; provided that the above groups can be substituted with other groups and that, in Formulae (I) and (III), the CN and X groups which are bonded to the same carbon atom can change positions with each other.

2. A thermal transfer dye-providing material as in claim 1, wherein n is 0.

3. A thermal transfer dye-providing material as in claim 1, wherein m is 0.

4. A thermal transfer dye-providing material as in claim 1, wherein $R_2$ and $R_3$ independently represent a hydrogen atom, an alkyl group, an alkoxy group, an acylamino group, or an alkoxycarbonylamino group.

5. A thermal transfer dye-providing material as in claim 4, wherein $R_2$ and $R_3$ independently represent a hydrogen atom, a methyl group, a methoxy group, an acetylamino group, a methoxycarbonylamino group, or an ethoxycarbonylamino group.

6. A thermal transfer dye-providing material as claim 1, wherein $R_4$ and $R_5$ each represent an alkyl group.

7. A thermal transfer dye-providing material as in claim 6, wherein $R_4$ and $R_5$ independently represent an ethyl group, a methanesulfonylaminoethyl group or a cyanoethyl group.

8. A thermal transfer dye-providing material as in claim 1, wherein $R_4$ and $R_5$ combine with each other to form a piperidine ring.

9. A thermal transfer dye-providing material as in claim 1, wherein $R_4$ combines with a benzene ring to form a tetrahydroquinoline ring.

10. A thermal transfer dye-providing material as in claim 1, wherein $R_6$ and $R_7$ independently represent an alkyl group, an alkoxy group or an alkoxycarbonylamino group.

11. A thermal transfer dye-providing material as in claim 10, wherein $R_6$ and $R_7$ independently represent a methyl group, a methoxy group, a methoxycarbonylamino group or an ethoxycarbonylamino group.

12. A thermal transfer dye-providing material as in claim 1, wherein X represents a cyano group, an alkoxycarbonyl group or a carbamoyl group.

13. A thermal transfer dye-providing material as in claim 1, wherein Ar has an electron-attracting property.

* * * * *